United States Patent [19]

Parkitny

[11] 4,171,523

[45] Oct. 16, 1979

[54] SIGNAL LIGHT

[75] Inventor: Felix Parkitny, Addison, Ill.

[73] Assignee: International Electric Co., Chicago, Ill.

[21] Appl. No.: 923,927

[22] Filed: Jul. 13, 1978

[51] Int. Cl.[2] ..... G08B 21/00

[52] U.S. Cl. ..... 340/654; 340/635

[58] Field of Search ..... 340/635, 654, 650; 256/10

[56] References Cited

U.S. PATENT DOCUMENTS 3,648,266 3/1972 Crist ..... 340/650

*Primary Examiner*—Harold I. Pitts

*Attorney, Agent, or Firm*—Rummler & Snow

[57] ABSTRACT

A lamp included in electric fences, at one or more posts thereof. The lamp indicates when an electric charge is flowing through the electric wire, at full charge, partial charge or no charge.

2 Claims, 6 Drawing Figures

SIGNAL LIGHT

BACKGROUND OF THE INVENTION

A person driving or walking at a distance from an electric fence has no means of ascertaining if the fence is charged or not, without checking the controller in the barn or actually touching the wire, or seeing an animal brush against the fence and quickly back away therefrom having been shocked.

A preliminary search has been conducted and the following patents were uncovered: U.S. Pat. Nos. 3,904,932, 2,476,033, 3,913,888, 3,364,424, 2,562,434. None of these patents disclose the concept of the present invention.

SUMMARY OF THE INVENTION

A lamp included in an electric fence at the fence post thereof and actuated by the current flowing through the wire. The amount of current is dependent on whether the fence is properly grounded at the control box known in the art as a charger. The object is being able to make a visual inspection, which may be done at a distance from the wire. If the lamp is fully bright, a person would immediately know the fence is fully charged; however, if the grounding at the fence controller is improper, the lamp will dimly glow; and when the lamp is not lighted, then the fence controller is either not properly grounded and no current flowing through the wire or the controller is not in operation.

BRIEF DESCRIPTION OF THE DRAWINGS

Figure 1:
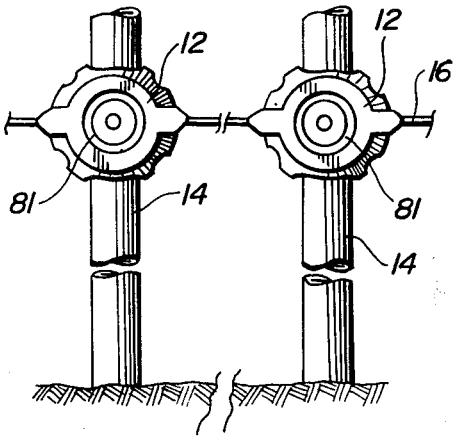
FIG. 1 is a front elevational view of the device of the present invention incorporated on a post.
Figure 2:
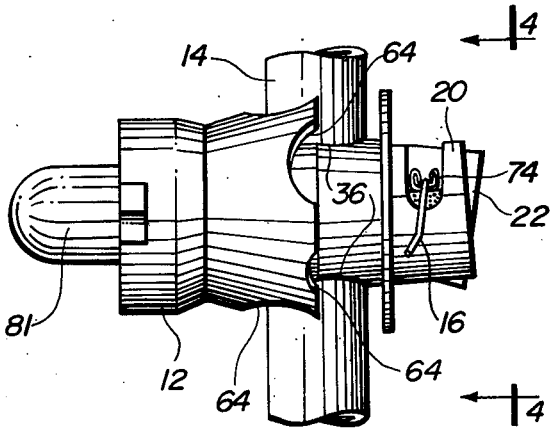
FIG. 2 is a side elevational view of the device of FIG. 1.

The device of the present invention is incorporated in the device of U.S. Pat. No. 3,913,888 issued Oct. 21, 1975, except the device of the patent is intended as an insulator for metal posts and applicant uses the post as a ground for a lamp.

The device of the aforesaid patent in essence comprises a body 12 of molded plastic having upwardly and downwardly projecting fingers 20, 22, respectively, for retaining the fence wire 16.

The rearward end 26 is elongated and contains a threaded shaft 28 and this portion of the body is partially hollowed as at 30. A bulbous segment 32 contains a perforation 36 to accommodate the upper end of a fence post 14 which extends transversely through the perforation 36.

The device also includes a flash guard 46, and a dome-shaped plastic washer 52 having an orifice 54 passing therethrough and a nut engaging face 58, which receives and bears against a threaded special plastic nut 60. The washer 52 is provided with a series of arcuate slots 64. Each of the slots 64 forms a clamp to bear against the post 14. The clamp cooperates to anchor the unit on the post 14.

Figure 3:
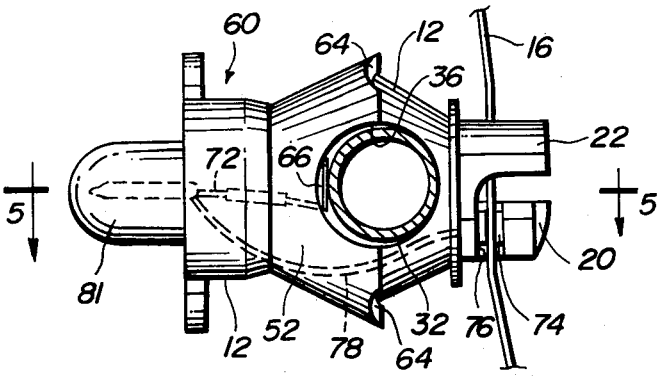
FIG. 3 is a top elevational view of the device of FIG. 2.
Figure 4:
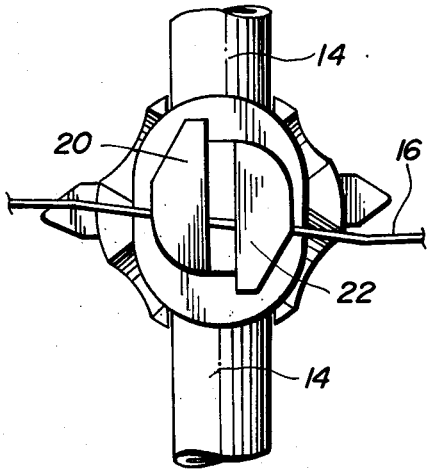
FIG. 4 is a rear elevational view of the device of FIG. 1 or taken on the line 4—4 of FIG. 3.
Figure 5:
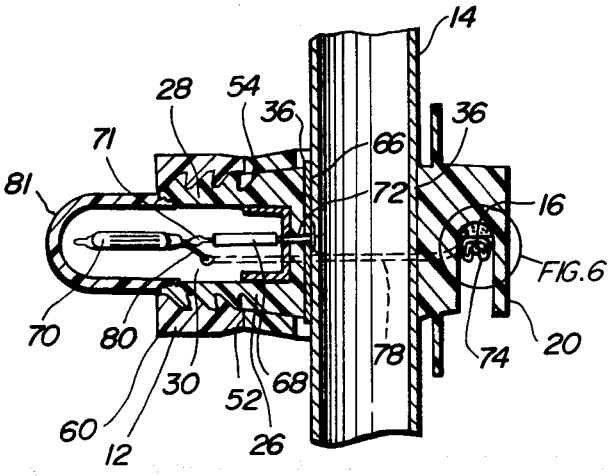
FIG. 5 is a cross-sectional view taken on the line 5—5 of FIG. 3.
Figure 6:
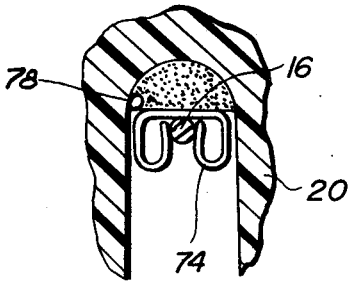
FIG. 6 is an enlarged view taken within the circle of FIG. 5.

The present invention comprises a flat metal plate 66 force fitted in perforation 36, as shown in FIGS. 3 and 5, and electrically connected to a resistor 68 and thence to one filament 71 of the lamp 70 through a wire 72.

A wire clip 74 is force fitted in the area between the finger 20 and its adjacent wall 76 of the body 12, as clearly shown in FIGS. 3 and 5, to support the fence wire 16. The clip is provided with a wire 78 and the wire is inserted into the body 12 and terminates in the hollow area 30 and is electrically secured to the other filament 80 of the lamp 70.

When the fencer controller is operating, the electric current will flow through the wire 16. The current in the wire will flow through the clip 74, the wire 78 and to the lamp, and thence through the wire 72 to plate 66 and thence to ground through the post 14, thus illuminating the lamp. For protection of the electrical elements, a domed reflector hood is anchored in the body to cover the hollow 30 and the lamp.

If the farmer or rancher is out in an area away from the electric fence, he can quickly tell whether the fence is operating at capacity by noting the brilliance of the glow of the lamp. If the glow of the lamp is dim or not glowing at all, he can readily known the fencer controller is inoperative or the ground at the controller is not proper. Thus he can quickly remedy the fault if the fencer is supposed to be operating.

Although but one specific embodiment of this invention is herein shown and described, it will be understood that details of the construction shown may be altered or omitted without departing from the spirit of the invention as defined by the following claims.

I claim:

1. A device for supporting an electrically conductive fence wire and securely mountable on a plurality of metal posts comprising:

an insulator body formed of insulative material and including fence wire retaining means capable of holding the fence wire, and further including an elongated, partially hollowed, threaded shaft having a post-receiving opening therethrough with entry and exit for the post;

a washer formed of insulative material and having a shaft-receiving orifice therethrough, said washer mounted on said shaft of said body passing through said orifice with said washer movable toward and away from said rod-receiving opening and capable of overlapping said opening of said shaft to reduce the effective size of said rod-receiving opening to bear against and closely confine said post within said opening;

a threaded nut threadably engaging said threaded shaft and adjacent said washer and in response to rotation of said nut urging said washer along said shaft toward said opening to successively further overlap said opening so as to be capable of gripping a rod between said washer and said body to securely hold said body on the post;

the improvement comprising a wire clip in said fence wire retaining means in which said fence wire is seated, a lamp positioned in said hollow of said shaft, said clip electrically connected to one side of said lamp, a metal plate frictionally secured in said post receiving opening of said shaft, and said plate electrically connected to the other side of said lamp.

2. The device of claim 1 wherein a resistor is connected between the plate and said other side of said lamp.

* * * * *